US007858182B2

(12) United States Patent
Takiue et al.

(10) Patent No.: US 7,858,182 B2
(45) Date of Patent: Dec. 28, 2010

(54) WHOLLY AROMATIC POLYAMIDE FIBERS EXCELLENT IN PROCESSABILITY AND ADHESIVENESS

(75) Inventors: Kotaro Takiue, Ehime (JP); Shoji Makino, Ehime (JP)

(73) Assignee: Teijin Techno Products Limited, Osaka (JP)

( * ) Notice: Subject to any disclaimer, the term of this patent is extended or adjusted under 35 U.S.C. 154(b) by 0 days.

(21) Appl. No.: 11/661,131

(22) PCT Filed: Aug. 31, 2004

(86) PCT No.: PCT/JP2004/012897

§ 371 (c)(1),
(2), (4) Date: Feb. 26, 2007

(87) PCT Pub. No.: WO2006/025113

PCT Pub. Date: Mar. 9, 2006

(65) Prior Publication Data

US 2007/0248820 A1 Oct. 25, 2007

(51) Int. Cl.
*D02G 3/00* (2006.01)

(52) U.S. Cl. ..... 428/375

(58) Field of Classification Search ..... 428/364, 428/375, 378

See application file for complete search history.

(56) References Cited

U.S. PATENT DOCUMENTS 5,304,422 A * 4/1994 Tanabe et al. ..... 428/392

FOREIGN PATENT DOCUMENTS

| | | | |
|---|---|---|---|
| JP | 53-147811 | | 12/1978 |
| JP | 58-54021 | A | 3/1983 |
| JP | 59-137535 | A | 8/1984 |
| JP | 59-163425 | A | 9/1984 |
| JP | 60-17112 | A | 1/1985 |
| JP | 60-52623 | A | 3/1985 |
| JP | 60-239523 | A | 11/1985 |
| JP | 62-049367 | | 3/1987 |
| JP | 62-149934 | | 7/1987 |
| JP | 06-081211 | A | 3/1994 |
| JP | 2004-162230 | A | 6/2004 |
| JP | 2005-015931 | A | 1/2005 |
| JP | 2005-299014 | A | 10/2005 |
| WO | 00/55401 | A1 | 9/2000 |

* cited by examiner

*Primary Examiner*—Arti Singh-Pandey
(74) *Attorney, Agent, or Firm*—Sughrue Mion, PLLC

(57) ABSTRACT

Wholly aromatic polyamide fibers having non-fusible fine powder attached to a surface thereof in an amount of from 1.5 to 14 mg/m$^2$, which are good in process stability in working processes, and exhibit excellent reinforcing effect upon using as a reinforcing material of rubber, resins and the like.

16 Claims, No Drawings

WHOLLY AROMATIC POLYAMIDE FIBERS EXCELLENT IN PROCESSABILITY AND ADHESIVENESS

TECHNICAL FIELD

The present invention relates to wholly aromatic polyamide fibers excellent in processability and adhesiveness. More specifically, it relates to such wholly aromatic polyamide fibers that are obtained by attaching non-fusible fine powder to a surface of fibers formed of wholly aromatic polyamide, is excellent in processability in a post-process, such as a thread twisting process, a weaving process and an adhering process, and is improved in adhesiveness to various kinds of matrices, such as rubber and resins.

BACKGROUND ART

It has been known that wholly aromatic polyamide fibers have various characteristics, such as excellent heat resistance and chemical resistance. Among them, a para-type wholly aromatic polyamide fibers are industrially used as a reinforcing material of various kinds of matrices and a rope owing to the excellent mechanical characteristics thereof, such as high strength and high elastic modulus.

However, in the case where the wholly aromatic polyamide fibers are heated in a high temperature atmosphere or used in a high temperature atmosphere, there is a problem that single fibers are fused to each other when the temperature is too high.

The wholly aromatic polyamide fibers are necessarily subjected to stretching at a high temperature and/or heat treatment for attaining high strength and high elastic modulus, but there is a problem that single fibers are fused to each other to fail to attain stable yarn-making or to reduce the mechanical characteristics of the resulting fibers. Furthermore, in the case where single fibers are partially fused to each other, the thread is lowered in flexibility to deteriorate the handleability thereof.

In order to solve the problems, JP-A-53-147811 and the like disclose a method of coating inorganic fine powder on wholly aromatic polyamide fibers having thermal fusibility before subjecting the fibers to heat stretching and/or heat treatment, whereby the fibers are prevented from being fused and simultaneously are improved in yarn-making property.

In the method, however, the inorganic fine powder coated on the fibers remain in a large amount after heat stretching and/or heat treatment, and thereby the method has a defect of causing such unfavorable effects in workability and adhesiveness that scums are liable to occur upon twisting the resulting fibers, and the adhesiveness to various matrices is liable to be lowered upon using as reinforcing fibers for rubber and resins.

In order to solve the problems, JP-A-62-149934 proposes a method of using particular inorganic fine powder, and after stretching and heat treatment, the inorganic fine powder coated on fibers is removed by subjecting the fibers to treatment of applying water and treatment of spraying an air stream. However, only by using the treatment of applying water and the treatment of spraying an air stream, it is difficult to remove the inorganic fine powder to a level capable of improving the workability sufficiently. The remaining amount can be decreased by repeating the treatments in plural times, but another problem occurs that the productivity is deteriorated to increase the cost.

Accordingly, it is the current situation that wholly aromatic polyamide fibers capable of providing such a high-performance product have not yet been proposed that is excellent in workability in various post-processes and is excellent in adhesiveness with various matrices.

DISCLOSURE OF THE INVENTION

The invention has been made in view of the aforementioned conventional techniques, and an object thereof is to provide such wholly aromatic polyamide fibers with high quality that are suppressed in formation of guide scums and the like in a post-process, such as a thread twisting process and a weaving process, and are excellent in adhesiveness as a reinforcing material of a composite material using rubber, an epoxy resin, a phenol resin or the like as a matrix.

Accordingly, the invention provides wholly aromatic polyamide fibers excellent in workability and adhesiveness, characterized in that non-fusible fine powder is attached to a surface thereof in an amount of from 1.5 to 14 mg/m$^2$.

BEST MODE FOR CARRYING OUT THE INVENTION

Embodiments of the invention will be described in detail below.

The wholly aromatic polyamide in the invention targets those obtained by polycondensation of an aromatic dicarboxylic acid, an aromatic diamine, an aromatic aminocarboxylic acid and the like at a ratio providing the substantially equimolar amounts of carboxyl groups and amino groups, and either the para-form and the meta-form may be used, but the para-form is preferred owing to such characteristics as high strength and high elastic modulus. Among these, in order to improve the strength and the elastic modulus of the fiber, those subjected to thermal stretching or heat treatment at a high temperature are preferred.

Specific examples of the wholly aromatic polyamide fibers include poly-m-phenylene isophthalamide fibers, poly-p-phenylene terephthalamide fibers and copoly-p-phenylene 3,4'-oxydiphenylene terephthalamide fibers. In particular, copoly-p-phenylene 3,4'-oxydiphenylene terephthalamide fibers are preferred as the fibers that the invention targets since unstretched fibers are necessarily stretched to at least 6 times under heating to a high temperature of 300° C. or more, and preferably from 350 to 550° C., for obtaining high strength fibers, whereby single fibers are liable to be softened and fused to each other to deteriorate the stretching property, and the fibers are often used as reinforcing fibers of various kinds of matrices.

The non-fusible fine powder used in the invention may be either an organic material or an inorganic material as far as the fine powder shows no fusibility near the softening temperature of the wholly aromatic polyamide fibers, and inorganic powder is preferred since it is chemically stable and does not exercise chemical action, such as oxidation, on the wholly aromatic polyamide fibers.

The size of the non-fusible fine powder is as small as possible, and it is preferred that the average particle diameter thereof is 20 μm or less, preferably 10 μm or less, and particularly preferably 5 μm or less, since the powder can be attached uniformly on the surface of single fibers.

The inorganic fine powder preferably has a granular crystalline structure or a scale-like crystalline structure. In the case where the inorganic fine powder has a scale-like crystalline structure, frictional resistance upon running the fibers having the fine powder attached thereto on a surface of a heated plate or a heated roller at a high temperature is reduced, thereby improving the workability. In the case where the inorganic fine powder has a granular crystalline structure, even when the fine powder is fixed to the surface of the fibers due to softening of the wholly aromatic polyamide, the powder can be easily removed since the contact area between the fibers and the fine powder is small, and thus the attached amount can be easily controlled to the range described later. On the other hand, amorphous inorganic fine powder, such as hectorite, which is hydrated in an aqueous dispersion liquid, is liable to coat uniformly the surface of the fibers in a film-like manner, whereby it is difficult to control the attached amount to the range described later.

The non-fusible fine powder is preferably not aggregated upon heating. The term "not aggregated upon heating" herein means that when an aqueous dispersion liquid of the powder is dried by heating to a temperature of 110° C. for 1 hour, the powder maintains the powder state. In the case where fine powder that is liable to be aggregated upon heating is used, the fine powder is liable to be aggregated in various processes carried out at a high temperature, and for example, when the fibers having been coated with the fine powder are subjected to a thermal stretching or a heat treatment at a high-temperature, it is difficult to remove the fine powder after the treatment, whereby it is difficult to control the attached amount to the range described later.

Specific examples of the non-fusible fine powder that is preferably used include anhydrous aluminum silicate and sodium aluminosilicate, and those having a granular crystalline structure are particularly preferred. These may be used solely or in combination of plural kinds thereof.

In the case where the attached amount of the non-fusible fine powder to the surface of the fibers is too large, scums are liable to occur in a post-process, such as a thread twisting process and a weaving process, and when the fibers are used as a reinforcing material, the adhesiveness to various kinds of matrices is lowered to fail to obtain a sufficient reinforcing effect. In the case where the attached amount is too small, friction among the single fibers and between the fibers and the frictional member, such as a guide, is increased, whereby fibrils are liable to occur, and breakage of the single fibers is liable to occur. Accordingly, the attached amount of the fine powder is necessarily from 1.5 to 14 mg/m$^2$, and preferably from 2.5 to 10 mg/m$^2$.

The state of attachment of the fine powder is not limited, and it is particularly preferred that the powder is fixed on the surface of the fibers by a heat treatment at a temperature near the softening point of the wholly aromatic polyamide. According to the operation, the adhesiveness of the fine powder to the surface of the fibers is improved to prevent the powder being dropped off in the post-process, whereby not only the process stability is improved, but also a product with high quality can be obtained.

In the case where the wholly aromatic polyamide is copoly-p-phenylene 3,4'-oxydiphenylene terephthalamide, for example, unstretched fibers formed of the polyamide are stretched to at least 6 times under heating to a high temperature of 300° C. or more, and preferably from 350 to 550° C., for attaining high strength and high elastic modulus, and the non-fusible fine powder can be fixed on the surface of the fibers under the condition.

The wholly aromatic polyamide fibers of the invention having been described are not particularly limited in production process thereof, and can be produced in the following manner with high efficiency. After applying a treating agent containing non-fusible fine powder to unstretched fibers formed of a wholly aromatic polyamide, the fibers are stretched depending on necessity under heating to a temperature near the softening point of the wholly aromatic polyamide, and then subjected to a heat treatment to fix the fine powder to the surface of the fibers. Subsequently, the fibers having the non-fusible fine powder fixed thereon are subjected to a moistening treatment, and then an air jet stream is sprayed on the fibers under such a condition that the target attached amount of the non-fusible fine powder is obtained. In this case, it is preferred that the non-fusible fine powder is one capable of being swelled with water since the fine powder can be easily dropped off from the surface of the fibers even after the fixing treatment.

EXAMPLE

The invention will be described more specifically with reference to examples below. The physical property values in the examples were measured in the following manner.

(1) Fineness, Breaking Strength, Breaking Elongation, and Modulus of Elasticity

These values were measured according to JIS L1013.

(2) Degree of Fusing

Among the total number (N) of filaments of a specimen of fibers, the number (n) of filaments that was capable of being separated to each other without fusing was counted, and the degree of fusing was obtained by the following expression. The measurement was carried out 5 times, and an average value was obtained.

$$\text{Degree of fusing (\%)}=\{(N-n)/2N\}\times 100$$

(3) Attached Amount of Non-fusible Fine Powder (DPU-1)

About 3 g of a specimen was obtained, to which no finishing oil had been applied. After drying the specimen at 120° C. for 1 hour, the weight A (g) thereof was precisely weighed. Subsequently, the specimen was completely ashed in an incinerator at 800° C., and the ash content weight B (g) after ashing was measured. The attached amount was calculated by the following expression.

$$\text{Attached amount (\%)}=\{B/(A-B)\}\times 100$$

(4) Attached Amount of Non-fusible Fine Powder (DPU-2)

The attached amount was calculated by the following expression. In the expression, D (%) is the attached amount in terms of percent by weight of the non-fusible fine powder obtained in the aforementioned manner, S (dtex) is the fineness of the monofilament, and R (μm) is the radius of the monofilament.

$$\text{Attached amount (mg/m}^2)=(S\times D\times 10)/(2R\times\pi\times 10^{-2})$$

(5) Quality of Product

A product wound in a cheese form of 5 kg with a winder was visually observed on the surface and the side surface thereof, and the quality of the product was determined from the numbers of fuzz and loops. A number of 5 or less was designated as a good product, and a number exceeding 5 was designated as a defective product.

(6) Amount of Scums

A fiber bundle was disposed to be in contact perpendicularly with a fixed ceramic bar guide having a diameter of 10 mm, and the fiber bundle was made run at a tension of 2.0 kg and a speed of 10 m/min for 5 minutes. The total amount of scums accumulated on the guide was measured.

Examples 1 to 3

112.9 parts of N-methyl-2-pyrrolidone (hereinafter, referred to as NMP) having a water content of 100 ppm or less, 1.506 parts of p-phenylene diamine and 2.789 parts of 3,4'-diaminodiphenyl ether were placed in a reactor at an ordinary temperature and dissolved in nitrogen, and then 5.658 parts of terephthalic chloride was added thereto under stirring. The reaction was finally carried out at 85° C. for 60 minutes to obtain a transparent viscous polymer solution. 9.174 parts of NMP slurry containing 22.5% by weight of potassium hydroxide was added thereto to effect neutralizing reaction. The resulting polymer had a logarithmic viscosity of 3.33.

The resulting polymer solution was subjected to wet fiber spinning by extruding from a die having a pore diameter of 0.3 mm and a pore number of 1,000 into a coagulation bath (aqueous solution) of 30% by weight of NMP. The distance between the surface of the fiber spinning die and the coagulation bath was 10 mm. Fibers spun from the fiber spinning die were washed with water, and water attached to the surface was removed with squeezing rollers. The fibers were dipped in an aqueous dispersion liquid of inorganic fine powder (anhydrous aluminum silicate with an average particle diameter of 1.1 μm, and sodium aluminosilicate with an average particle diameter of 2.1 μm) of a concentration of 2.0% by weight having the composition shown in Table 1 for about 1 second, and then subjected to squeezing rollers, whereby threads having the inorganic fine powder liquid attached were obtained.

Subsequently, the threads were completely dried by using a drying roller having a surface temperature of 200° C. and then stretched under heating at 530° C. to 10 times.

The resulting stretched threads were sprayed with water by showering at an amount of 10 L/min to moisten the stretched threads sufficiently. An air stream was then sprayed thereon through an air nozzle having an inner diameter of 1.5 mm and a length of 10 mm at 200 L/min. After repeating these operations twice, a finishing oil was applied thereto at an attached amount of 2.5% by weight, and the threads were wound at a speed of 500 m/min. The resulting fibers had a number of filaments of 1,000 and a fineness of 1,670 dtex. The evaluation results are shown in Table 1.

Comparative Example 1

The same procedures as in Example 1 were carried out except that inorganic fine powder having the composition shown in Table 1 was used instead of anhydrous aluminum silicate and sodium aluminosilicate in Example 1. The results are shown in Table 1.

Comparative Example 2

The same procedures as in Example 1 were carried out except that the air stream spraying treatment in Example 1 was not carried out. The results are shown in Table 1.

The fibers obtained in Example 1, Comparative Example 1 and Comparative Example 2 were evaluated by comparing in scum forming amount. The results are shown in Table 2.

TABLE 2

| | Example 1 | Comparative Example 1 | Comparative Example 2 |
|---|---|---|---|
| Total amount of scums (g) | 0.01 | 0.17 | 0.45 |

The fibers obtained in Example 1, Comparative Example 1 and Comparative Example 2 were evaluated by comparing in adhesiveness to a matrix. Rubber or a resin used for the evaluation is not particularly limited, and examples of the usable rubber include acrylic rubber, acrylonitrile-butadiene rubber, hydrogenated acrylonitrile-butadiene rubber, isoprene rubber, urethane rubber, ethylene-propylene rubber, epichlorohydrin rubber, chlorosulfonated polyethylene rubber, chloroprene rubber, silicone rubber, styrene-butadiene rubber, polysulfide rubber, natural rubber, butadiene rubber, butyl rubber and fluorocarbon rubber.

Examples of the usable resin include an epoxy resin, an unsaturated polyester resin, a vinyl ester resin, a phenol resin, polyvinyl acetate, polycarbonate, polyacetal, polyphenylene oxide, polyphenylene sulfide, polyarylate, polyester, polyamideimide, polyimide, polyetherimide, polysulfone, polyethersulfone, polyetherether ketone, polyaramid, polybenzoimidazole, polyethylene, polypropylene, cellulose acetate and cellulose butyrate.

In the evaluation, natural rubber (NR)/styrene-butadiene rubber (SBR) was used for evaluating adhesiveness to rubber used as tires and belts, which were general purposes of rubber. Chloroprene rubber was used for evaluating adhesiveness to rubber used as hoses. An epoxy resin was used for evaluating adhesiveness where the fibers were used for reinforcing a general-purpose resin.

The evaluation method is described in detail below.

(7) Evaluation of Adhesion to Rubber

The fibers obtained in Example 1, Comparative Example 1 and Comparative Example 2 each was twisted to a twist number of 30 T/cm (Z twisting) to provide single cords, and two single cords thus obtained were twisted to a twist number of 30 T/cm (S twisting) to provide a cord for evaluation.

According to an ordinary two-bath treating method, the resulting cord for evaluated was attached with an epoxy resin

TABLE 1

| | Example 1 | Example 2 | Example 3 | Comparative Example 1 | Comparative Example 2 |
|---|---|---|---|---|---|
| Anhydrous aluminum silicate (%) | 50 | 100 | — | — | 50 |
| Sodium aluminosilicate (%) | 50 | — | 100 | — | 50 |
| Aluminum silicate (%) | — | — | — | 85 | — |
| Magnesium silicate (%) | — | — | — | 15 | — |
| Removal of fine powder | implemented | implemented | implemented | implemented | none |
| DPU (%) | 0.06 | 0.32 | 0.28 | 0.92 | 0.68 |
| (mg/m$^2$) | 2.6 | 13.8 | 12.0 | 39.9 | 29.2 |
| Breaking strength (cN/dtex) | 24.8 | 24.9 | 24.9 | 24.8 | 24.7 |
| Breaking elongation (%) | 4.28 | 4.31 | 4.16 | 4.49 | 4.42 |
| Modulus (cN/dtex) | 533 | 532 | 529 | 523 | 521 |
| Degree of fusing (%) | <1 | <1 | <1 | <1 | <1 |
| Quality | good | good | good | good | good |

in the first treating bath and an RFL adhesion liquid in the second treating bath in a total adhesion amount of 8.0% by weight.

The treated cord thus obtained was embedded in a center of natural rubber (NR)/styrene-butadiene rubber (SBR) having a thickness of 4 mm in parallel to each other with a distance of 7 mm, and after subjecting to vulcanization at 150° C. for 30 minutes with a pressure of 50 kg/cm$^2$, the rubber was slit in parallel to the fibers to a width of 7 mm to obtain a test piece.

The test piece thus obtained was measured for the drawing strength upon drawing the cord in the direction in parallel to the cord and the peeling strength upon peeling the cord from the rubber in the direction perpendicular to the cord at a rate of 200 mm/min. The results are shown in Table 3.

Similarly, the treated cord thus obtained was placed on a chloroprene (CR) rubber sheet having a thickness of 2 mm in parallel to each other, and the similar CR rubber sheet was superimposed on the cord, which were subjected to vulcanization at 150° C. for 30 minutes with a pressure of 50 kg/cm$^2$. The resulting rubber sheet was measured in the same manner. The results are shown in Table 3.

(8) Evaluation of Adhesion to Resin

A woven fabric having a density of 17 per inch in warp direction and 17 per inch in weft direction was obtained by using the fibers obtained in Example 1, Comparative Example 1 and Comparative Example 2.

The woven fabric was impregnated with a bisphenol A epoxy resin (Epikote 828, produced by Japan Epoxy Resin Co., Ltd.) mixed with a curing agent to produce a prepreg having a fiber content of 40% based on the total weight. Six sheets of the prepregs were laminated and subjected to vacuum press at a temperature of 180° C. for 2 hours to produce an FRP plate having a thickness of 2 mm.

A test piece of the resulting FRP plate was measured for interlayer shearing strength (ILSS) according to the method disclosed in JIS K7078. The results are shown in Table 3.

TABLE 3

| Evaluation of adhesiveness | Example 1 | Comparative Example 1 | Comparative Example 2 |
|---|---|---|---|
| (NR/SBR) | | | |
| Drawing strength (N/cm) | 210 | 180 | 177 |
| Peeling strength (N/cord) | 18.7 | 13.1 | 12.8 |
| (CR) | | | |
| Drawing strength (N/cm) | 204 | 175 | 177 |
| Peeling strength (N/cord) | 5.50 | 3.96 | 3.92 |
| (Epoxy resin) | | | |
| ILSS (MPa) | 49.6 | 40.3 | 39.1 |

INDUSTRIAL APPLICABILITY

According to the invention, such wholly aromatic polyamide fibers are obtained that cause no scum in a weaving process and a thread twisting process, are good in process stability in the working processes owing to suppressed friction to a guide or the like, and exhibit excellent reinforcing effect upon using as a reinforcing material of rubber, resins and the like owing to good adhesiveness with various kinds of matrices.

The invention claimed is:

1. Wholly aromatic polyamide fibers excellent in workability and adhesiveness, wherein a non-fusible fine powder; is attached to a surface thereof in an amount of from 1.5 to 14 mg/m$^2$; and the non-fusible fine powder is composed of anhydrous aluminum silicate and/or sodium aluminosilicate.

2. The wholly aromatic polyamide fibers excellent in workability and adhesiveness according to claim 1, wherein the non-fusible fine powder has an average particle diameter of 20 μm or less.

3. The wholly aromatic polyamide fibers excellent in workability and adhesiveness according to claim 1, wherein the wholly aromatic polyamide is a para-type wholly aromatic copolyamide.

4. The wholly aromatic polyamide fibers excellent in workability and adhesiveness according to claim 2, wherein the wholly aromatic polyamide is a para-type wholly aromatic copolyamide.

5. The wholly aromatic polyamide fibers excellent in workability and adhesiveness according to claim 1, wherein the non-fusible fine powder is composed of anhydrous aluminum silicate.

6. The wholly aromatic polyamide fibers excellent in workability and adhesiveness according to claim 2, wherein the non-fusible fine powder is composed of anhydrous aluminum silicate.

7. The wholly aromatic polyamide fibers excellent in workability and adhesiveness according to claim 3, wherein the non-fusible fine powder is composed of anhydrous aluminum silicate.

8. The wholly aromatic polyamide fibers excellent in workability and adhesiveness according to claim 4, wherein the non-fusible fine powder is composed of anhydrous aluminum silicate.

9. The wholly aromatic polyamide fibers excellent in workability and adhesiveness according to claim 1, wherein the non-fusible fine powder is composed of sodium aluminosilicate.

10. The wholly aromatic polyamide fibers excellent in workability and adhesiveness according to claim 2, wherein the non-fusible fine powder is composed of sodium aluminosilicate.

11. The wholly aromatic polyamide fibers excellent in workability and adhesiveness according to claim 3, wherein the non-fusible fine powder is composed of sodium aluminosilicate.

12. The wholly aromatic polyamide fibers excellent in workability and adhesiveness according to claim 4, wherein the non-fusible fine powder is composed of sodium aluminosilicate.

13. The wholly aromatic polyamide fibers excellent in workability and adhesiveness according to claim 1, wherein the non-fusible fine powder is composed of anhydrous aluminum silicate and sodium aluminosilicate.

14. The wholly aromatic polyamide fibers excellent in workability and adhesiveness according to claim 2, wherein the non-fusible fine powder is composed of anhydrous aluminum silicate and sodium aluminosilicate.

15. The wholly aromatic polyamide fibers excellent in workability and adhesiveness according to claim 3, wherein the non-fusible fine powder is composed of anhydrous aluminum silicate and sodium aluminosilicate.

16. The wholly aromatic polyamide fibers excellent in workability and adhesiveness according to claim 4, wherein the non-fusible fine powder is composed of anhydrous aluminum silicate and sodium aluminosilicate.

* * * * *